US005712242A

United States Patent [19]

Aouad et al.

[11] Patent Number: 5,712,242

[45] Date of Patent: Jan. 27, 1998

[54] HIGH ACTIVE GRANULAR DETERGENTS COMPRISING CHELANTS AND POLYMERS, AND PROCESSES FOR THEIR PREPARATION

[75] Inventors: Yousef Georges Aouad, Brussel; Jose Luis Vega; Adrian John Waynforth Angell, both of Strombeek-Bever, all of Belgium

[73] Assignee: The Procter & Gamble Company, Cincinnati, Ohio

[21] Appl. No.: 532,555

[22] PCT Filed: Feb. 23, 1994

[86] PCT No.: PCT/US94/01917

§ 371 Date: Dec. 11, 1995

§ 102(e) Date: Dec. 11, 1995

[87] PCT Pub. No.: WO94/22992

PCT Pub. Date: Oct. 13, 1994

[30] Foreign Application Priority Data

Mar. 30, 1993 [EP] European Pat. Off. ..... 93870058.0

[51] Int. Cl.[6] ..... C11D 11/00; C11D 3/20; C11D 3/37; C11D 17/00

[52] U.S. Cl. ..... 510/444; 510/336; 510/352; 510/357; 510/361; 510/404; 510/469; 510/476; 510/478; 510/480; 510/507

[58] Field of Search ..... 510/444, 443, 510/404, 336, 361, 434, 436, 431, 469, 476, 533, 352, 357, 478, 480, 507

[56] References Cited

U.S. PATENT DOCUMENTS

| | | | |
|---|---|---|---|
| 4,704,233 | 11/1987 | Hartman et al. | 510/337 |
| 5,366,652 | 11/1994 | Capeci et al. | 510/444 |
| 5,451,354 | 9/1995 | Aouad et al. | 264/117 |
| 5,486,303 | 1/1996 | Capeci et al. | 510/444 |
| 5,494,599 | 2/1996 | Goovaerts et al. | 510/443 |

*Primary Examiner*—Ardith Hertzog

*Attorney, Agent, or Firm*—K. K. Patel; K. W. Zerby; J. C. Rasser

[57] ABSTRACT

A free-flowing granular detergent component or composition having a bulk density of at least 650 g/l comprises (i) at least 35% by weight of anionic surfactant; (ii) 0.5% to 10% by weight of a chelating agent; (iii) 0.5% to 30% by weight of a polymer or co-polymer wherein the weight ratio of chelating agent to polymer/copolymer is from 1:100 to 1:1. Additionally, processes for making the granular detergent component or composition comprise adding aqueous solutions of a chelating agent and a polymer or copolymer to a high active surfactant paste.

13 Claims, No Drawings

HIGH ACTIVE GRANULAR DETERGENTS COMPRISING CHELANTS AND POLYMERS, AND PROCESSES FOR THEIR PREPARATION

BACKGROUND OF THE INVENTION

The present invention relates to a high active surfactant paste composition and to high active granular detergent components and compositions which can be made using such paste compositions. The invention also relates to a process for making these pastes, and granular components and compositions.

In recent years there has been a trend towards making granular detergents having a higher bulk density than before. Various techniques of making dense granular detergents, and of processing low density granular detergents in such a way that the bulk density is increased, have been described. One example of a suitable technique for making dense granular detergents is known as "agglomeration". This term describes any process in which small particles of the components are processed in such a way that they are built-up (or "agglomerated") to form suitable granular components.

The ideal detergent agglomerate should have a high bulk density and a high surfactant content and yet still have good solubility and dispersion properties. It should also be possible to use a manufacturing process which is both efficient and versatile.

Different approaches to these objectives have been made in the prior art.

U.S. Pat. No. 5,080,848, published on Jan. 14, 1992 describes a process for making surfactant granules typically having an anionic surfactant activity of 50% to 75% (see examples 1 to 8). The process involves chilling and granulating a viscous high active surfactant paste. The granulation may be performed with the aid of some detergency builders (see examples 3 and 4), but the emphasis is on reducing the temperature in order to initiate granulation. The finished detergent composition may contain other optional ingredients including chelating agents, but there is no indication of any advantages of adding solutions of chelating agent and .polymers directly to the paste.

EP 0 508 543, published on Oct. 14, 1992 discloses methods of chemically conditioning high active surfactant pastes in order to achieve high active detergent granules. Phosphonates, polymers and copolymers are disclosed as useful conditioning agents. Conditioning of a paste may be achieved by, for example, increasing paste viscosity and/or drying.

An example of paste conditioning by the addition of powdered co-polymer is given. However there is no suggestion of the benefits of using solutions of chelant and polymer together.

The prior art suggests that in order to maximise the surfactant activity it is necessary to minimise the amount of water in the surfactant paste. This has resulted in the need to handle surfactant pastes having an increasingly high viscosity which imposes limits on the flexibility of the process. However, it has now been found that it is possible to further improve the process in order to make agglomerates which have still higher surfactant activity, and still maintain, or further improve the desired physical characteristics of the granular detergent.

The present invention addresses the problems of how to make higher active surfactant particles than possible using the disclosures in prior art and how to increase the rate of solubility of the resulting particles. There is no need to cool the paste during the granulation step, and the resulting agglomerates have an activity of at least 35%, preferably at least 50%, and more preferably at least 60%.

It has now been surprisingly found that it is advantageous to incorporate a chelating agent and a polymer or co-polymer in the form of an aqueous solution. In particular, it has been found that a narrowly defined ratio of chelating agent to polymer or co-polymer gives the benefits sought.

The present invention allows the handling of paste compositions which contain more water than those of the prior art, which therefore have a correspondingly lower viscosity, and yet still result in granular detergents having a very high surfactant composition.

SUMMARY OF THE INVENTION

A free-flowing granular detergent component or composition having a bulk density of at least 650 g/l which comprises i) at least 35% by weight of anionic surfactant ii) 0.5% to 10% by weight of a chelating agent iii) 0.5% to 30% by weight of a polymer or co-polymer wherein the weight ratio of chelating agent to polymer/co-polymer is from 1:100 to 1:1. A process for making the granular detergent component or composition is also described. It is an essential feature of this process that aqueous solutions of a chelating agent and a polymer or co-polymer are added to a high active surfactant paste.

DETAILED DESCRIPTION OF THE INVENTION

Different aspects of the present invention are a high active surfactant paste, high active detergent granular detergent made from this paste, and a process for making the paste and the granular detergent. Each of these aspects of the invention will now be discussed in more detail.

High Active Surfactant Paste

The high active surfactant paste of the present invention comprises three essential components, a surfactant premix, a chelating agent and a polymer or copolymer. It is also an essential feature of the invention that the chelating agent and the polymer or copolymer are in the form of aqueous solutions. The three essential components may then be mixed together in any convenient order. The ratio of chelating agent to polymer/copolymer has now been found to be essential for making high active agglomerates having a good rate of solubility. The ratio of chelating agent to polymer/copolymer in the present invention should be from 1:100 to 1:1; and preferably from 1:50 to 1:2, and more preferably from 1:20 to 1:5. Most preferably the ratio is about 1:7.

Paste Premix

One or various aqueous pastes of the salts of anionic surfactants is preferred for use in the present invention, preferably the sodium salt of the anionic surfactant. While granulation using various pure or mixed surfactants is known, for the present invention to be of practical use in industry and to result in particles of adequate physical properties to be incorporated into granular detergents, an anionic surfactant must be part of the paste in a concentration of above 40%, preferably from 40%–95%.

The activity of the aqueous surfactant paste premix is at least 40% and can go up to about 95%; preferred activities are: 50–80% and 65–75%. The balance of the paste premix is primarily water but can include a processing aid such as a nonionic surfactant. At the higher active concentrations, little or no builder is required for cold granulation of the paste. The resultant concentrated surfactant granules can be added to dry builders or powders or used in conventional agglomeration operations. The aqueous surfactant paste premix contains an organic surfactant selected from the group consisting of anionic, zwitterionic, ampholytic and cationic surfactants, and mixtures thereof. Anionic surfactants are preferred. Nonionic surfactants are used as secondary surfactants or processing aids and are not included herein as an "active" surfactant. Surfactants useful herein are listed in U.S. Pat. No. 3,664,961, Norris, issued May 23, 1972, and in U.S. Pat. No. 3,919,678, Laughlin et al., issued Dec. 30, 1975. Useful cationic surfactants also include those described in U.S. Pat. No. 4,222,905, Cockrell, issued Sep. 16, 1980, and in U.S. Pat. 4,239,659, Murphy, issued Dec. 16, 1980. However, cationic surfactants are generally less compatible with the aluminosilicate materials herein, and thus are preferably used at low levels, if at all, in the present compositions. The following are representative examples of surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; watersoluble salts of-olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety. Although the acid salts are typically discussed and used, the acid neutralization cam be performed as part of the fine dispersion mixing step.

The preferred anionic surfactant pastes are mixtures of linear or branched alkylbenzene sulfonates having an alkyl of 10–16 carbon atoms and alkyl sulfates having an alkyl of 10–18 carbon atoms. These pastes are usually produced by reacting a liquid organic material with sulfur trioxide to produce a sulfonic or sulfuric acid and then neutralizing the acid to produce a salt of that acid. The salt is the surfactant paste discussed throughout this document. The sodium salt is preferred due to end performance benefits and cost of NaOH vs. other neutralizing agents, but is not required as other agents such as KOH may be used.

Water-soluble nonionic surfactants are also useful as secondary surfactant in the compositions of the invention. Indeed, preferred processes use anionic/nonionic blends. A particularly preferred paste comprises a blend of nonionic and anionic surfactants having a ratio of from about 0.01:1 to about 1:1, more preferably about 0.05:1. Nonionics can be used up to an equal amount of the primary organic surfactant. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 4 to 25 moles of ethylene oxide per more of alcohol. Particularly preferred are the condensation products of alcohols having an alkyl group containing from about 9 to 15 carbon atoms with from about 4 to 25 moles of ethylene oxide per mole of alcohol; and condensation products of propylene glycol with ethylene oxide.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Particularly preferred surfactants herein include linear alkylbenzene sulfonates containing from about 11 to 14 carbon atoms in the alkyl group; tallow alkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethylamine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of C9–C15 alcohols with from about 3 to 8 moles of ethylene oxide, and mixtures thereof.

Useful cationic surfactants include. Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocalkyl trimethyl ammonium methosulfate.

Specific preferred surfactants for use herein include: sodium linear $C_{11}$–$C_{13}$ alkylbenzene sulfonate; alpha-olefin sulphonates; triethanolammonium $C_{11}$–$C_{13}$ alkylbenzene sulfonate; alkyl sulfates, (tallow, coconut, palm, synthetic origins, e.g. $C_{45}$, etc.); sodium alkyl sulfates; MES; sodium coconut alkyl glyceryl ether sulfonate; the sodium salt of a sulfated condensation product of a tallow alcohol with about 4 moles of ethylene oxide; the condensation product of a coconut fatty alcohol with about 6 moles of ethylene oxide; the condensation product of tallow fatty alcohol with about 11 moles of ethylene oxide; the condensation of a fatty alcohol containing from about 14 to about 15 carbon atoms with about 7 moles of ethylene oxide; the condensation product of a $C_{12}$–$C_{13}$ fatty alcohol with about 3 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio) hexanoate; dodecyldimethylamine oxide; coconutalkyldimethylamine oxide; and the water-soluble sodium and potassium salts of coconut and tallow fatty acids.

Two important parameters of the surfactant pastes which can affect the mixing and granulation step are the paste temperature and viscosity. Viscosity is a function, among others, of concentration and temperature, with a range in this application from about 10,000 cps to 10,000,000 cps. Preferably, the viscosity of the paste entering the system is from about 20,000 to about 100,000 cps. and more preferably from about 30,000 to about 70,000 cps. The viscosity of the paste of this invention is measured at a temperature of 70° C. when measured at $25s^{-1}$. For the present purposes a Physica Viscotherm VT100 was used for measuring viscosity.

Chelating Agents

The chelating agents suitable for use in the present invention can be chosen from a wide range of chemicals which are known to the man skilled in the art. Examples of suitable chelating agents are phosphonic and succinic acids and their salts.

The polyphosphonates are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Examples of particularly suitable chelating agents are ethylene diamine tetra (methylene phosphonic acid) and diethylene triamine penta (methylene phosphonic acid).

Another preferred chelating agent is ethylenediamine-N, N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include NaEDDS, $Na_2$EDDS and $Na_4$EDDS. Examples of such preferred magnesium salts of EDDS include Mg EDDS and $Mg_2$EDDS. The magnesium salts are the most preferred for inclusion in compositions in accordance with the invention. The structure of the acid form of EDDS is as follows:

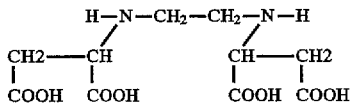

EDDS can be synthesised, for example, from readily available, inexpensive starting material such as maleic anhydride and ethylene diamine as follows:

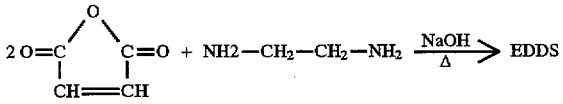

A more complete disclosure of methods for synthesising EDDS from commercially available starting materials can be found in U.S. Pat. No. 3,158,635, Kezerian and Ramsay, issued Nov. 24, 1964.

The synthesis of EDDS from maleic anhydride and ethylene diamine yields a mixture of three optical isomers, [R,R],[S,S], and [S,R], due to the two asymmetric carbon atoms. The biodegradation of EDDS is optical isomerspecific, with the [S,S] isomer degrading most rapidly and extensively, and for this reason the [S,S] isomer is most preferred for inclusion in the compositions of the invention.

The [S,S] isomer of EDDS can be synthesised from L-aspartic acid and 1,.2-dibromoethane, as follows:

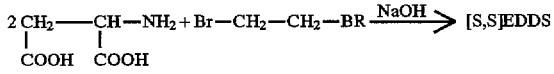

A more complete disclosure of the reaction of L-aspartic acid with 1,2-dibromoethane to form the [S,S] isomer of EDDS can be found in Neal and Rose, Stereospecific Ligands and Their Complexes of Ethylenediaminediscuccinic Acid, *Inorganic Chemistry,* Vol 7 (1968), pp. 2405–2412.

The concentration of the aqueous solutions of the chelating agent is not critical in the present invention. However, it is convenient to use solutions which are readily available commercially. Aqueous solutions having a concentration of from 5% to 60% of the chelating agent are suitable.

Polymers and/or Co-polymers

The polymers and co-polymers of the present invention may be chosen from a wide range of organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates, polyaspartates, polyvinylpyrrolidones and various copolymers, such as those of maleic and acrylic acids. Molecular weights for such polymers vary widely but most are within the range of 2,000 to 100,000.

Polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Most preferred for use in the present invention are copolymers of maleic and acrylic acid having a molecular weight of from 2000 to 100000, carboxymethyl cellulose and mixtures thereof.

The concentration of the aqueous solutions of the polymer or copolymer is not critical in the present invention. However, it is convenient to use solutions which are readily available commercially. Aqueous solutions having a concentration of from 5% to 60% of the polymer or copolymer are suitable.

Granular Detergent Components

It is another aspect of the invention that the high active surfactant paste described hereinabove may be treated by any suitable process, for example agglomeration with powders to form granular detergent components or compositions. In a preferred embodiment of the invention, the high active surfactant paste is mixed by fine dispersion mixing and granulation with an effective amount. of powder.

Any compatible detergency builder or combination of builders or powder can be used in the process and compositions of the present invention.

The detergent compositions herein can contain crystalline aluminosilicate ion exchange material of the formula $$Na_z[(AlO_2)_z\cdot(SiO_2)_y]\cdot xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2\cdot ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[(AlO_2)_{12}(SiO2)_{12}]\cdot xH_2O$$

wherein x is from about 20 to about 30, especially about 27 and has a particle size generally less than about 5 microns.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt. Citric acid and, in general, any other organic or inorganic acid may be incorporated into the granular detergents of the present invention as long as it is chemically compatible with the rest of the agglomerate composition.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhyroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4. The compositions made by the process of the present invention does not require excess carbonate for processing, and preferably does not contain over 2% finely divided calcium carbonate as disclosed in U.S. Pat. No. 4,196,093, Clarke et al., issued Apr. 1, 1980, and is preferably free of the latter.

As mentioned above powders normally used in detergents such as zeolite, carbonate, silica, silicate, citrate, phosphate, perborate, etc. and process acids such as starch, can be used in preferred embodiments of the present invention.

Processing

The process steps of the present invention comprise:

1. Mixing a surfactant premix with solutions of chelant and polymer
2. Drying (optional)
3. Transferring to a high speed mixer, preferably by means of a twin screw extruder.
4. Agglomerating surfactant paste with an effective amount of powder It will be understood that any convenient order of the process steps listed above can be contemplated. Also it may be possible and even advantageous to carry out two or more of the above operations in a single piece of process equipment. Each of these operations will now be described in more detail.

Making a Paste Premix

The surfactant paste premix may be prepared by any method which is known to the man skilled in Me art. Particularly useful methods include sulphation and/or sulphonation or other reactions to make the desired anionic surfactants e.g. in a falling film sulphonating reactors, digestion tanks, esterification reactors, etc. It is particularly convenient to neutralise the acid precursers of anionic surfactants in a continuous neutralisation loop. In such a piece of equipment the acid precurser is fed into a loop together with a neutralising agent such as aqueous sodium hydroxide. The components are intimately mixed to promote neutralisation and then fed through a heat exchanger to be cooled. A proportion of the neutralised surfactant is removed from the loop, whilst the remainder is fed back to the point of injection of the acid and the alkali, and passes around the loop again.

In the present invention the surfactant paste must then be mixed with a solution of a chelating agent and a solution of a polymer-or co-polymer. This may be achieved in any convenient piece of mixing equipment, and may be carried out using any order of addition of the separate or pre-mixed components.

Paste Drying (in-line)

It is preferred that the moisture in the surfactant aqueous paste is as low as possible, while maintaining paste fluidity, since low moisture leads to a higher concentration of the surfactant in the finished particle. Preferably the paste after drying contains between 5 and 40% water, more preferably between 15 and 35% water and most preferably between 15% and 25% water. A highly attractive mode of operation for lowering the moisture of the paste is the installation, in line, of an atmospheric or a vacuum flash drier, or a scraped surface heat exchanger or a wiped film evaporator.

Twin Screw Extruder

The extruder fulfils the functions of pumping and mixing the viscous surfactant paste on a continuous basis. A basic extruder consists of a barrel with a smooth inner cylindrical surface. Mounted within this barrel is the extruder screw. There is an inlet port for the high active paste which, when the screw is rotated, causes the paste to be moved along the length of the barrel. The detailed design of the extruder allows various functions to be carried out. Firstly additional ports in the barrel may allow other ingredients, including the chemical structuring agents to be added directly into the barrel. Secondly a vacuum pump and a seal around the shaft of the screw allows a vacuum to be drawn which enables the moisture level to be reduced. Thirdly means for heating or cooling may be installed in the wall of the barrel for temperature control. Fourthly, careful design of the extruder screw promotes mixing of the paste both with itself and with other additives. A preferred extruder is the twin screw extruder. This type of extruder has two screws mounted in parallel within the same barrel, which are made to rotate either in the same direction (co-rotation) or in opposite directions (counter-rotation). The co-rotating twin screw extruder is the most preferred piece of equipment for use in this invention. An extruder is particularly useful in this invention because the paste can be effectively cooled by adding liquid nitrogen or solid carbon dioxide into the barrel (this may be considered surprising, because normally an extruder heats its contents as a result of the mechanical energy input to overcome viscous shear forces) and at the same time pumps the increasingly viscous (colder) paste out of the extruder and into the mixer/agglomerator were granulation takes place.

Suitable twin screw extruders for use in the present invention include those supplied by: APV Baker, (CP series); Werner and Pfleiderer, (Continua Series); Wenger, (TF Series); Leistritz, (ZSE Series); and Buss, (LR Series).

The extruder allows the paste to be conditioned by moisture and temperature reduction. Moisture may be removed under vacuum, preferably between 0 mmHg (gauge) and −55 mmHg (gauge), (0–7.3 kPa below atmospheric pressure).

Temperature may be reduced by the addition of solid carbon dioxide or liquid nitrogen directly into the extruder barrel. However, this is not a preferred mode of operation of the present invention.

Fine Dispersion Mixing and Granulation

Any apparatus, plants or units suitable for the processing of surfactants can be used for carrying out the process according to the invention. For mixing/agglomeration any of a number of mixers/agglomerators can be used. In one preferred embodiment, the process of the invention is continuously carried out. Especially preferred are mixers of the Fukae$^R$ FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention include Diosna$^R$ V series ex Dierks & Söhne, Germany;.and the Pharma Matrix$^R$ ex T K Fielder Ltd., England. Other mixers believed to be suitable for use in the process of the invention are the Fuji$^R$ VG-C series ex Fuji Sangyo Co., Japan; and the Roto$^R$ ex Zanchetta & Co srl, Italy.

Other preferred suitable equipment can include Eirich$^R$, series RV, manufactured by Gustau Eirich Hardheim, Germany; Lödige$^R$, series FM for batch mixing, series Baud KM for continuous mixing/agglomeration, manufactured by L ödige Machinenbau GmbH, Paderborn Germany; Drais$^R$ T160 series, manufactured by Drais Werke GmbH, Mannheim Germany; and Winkworth$^R$ RT 25 series, manufactured by Winkworth Machinery Ltd., Berkshire, England.

The Littleford Mixer, Model #FM-130-D-12, with internal chopping blades and the Cuisinart Food Processor, Model #DCX-PluS, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an, axis of rotation, is preferred. The invention can be practiced as a batch or a continuous process.

The paste can be introduced into the mixer at an initial temperature between its softening point (generally in the range of 40°–60° C.) and its degradation point (depending on the chemical nature of the paste, e.g. alkyl sulphate pastes tend to degrade above 75°–85° C.). High temperatures reduce viscosity simplifying the pumping of the paste but result in lower active agglomerates.

The introduction of the paste into the mixer can be done in many ways, from simply pouring to high pressure pumping through small holes at the end of the pipe, before the entrance to the mixer. While all these ways are viable to manufacture agglomerates with good physical properties, it has been found that in a preferred embodiment of the present invention the extrusion of the paste results in a better distribution in the mixer which improves the yield of particles with the desired size. The use of high pumping pressures prior to the entrance in the mixer results in an increased activity in the final agglomerates. By combining both effects, and introducing the paste through holes (extrusion) small enough to allow the desired flow rate but that keep the pumping pressure to a maximum feasible in the system, highly advantageous results are achieved.

A suitable residence time is from 1 to 30 seconds.

It is also within the scope of the present invention that the resulting detergent granules may be dried, cooled and/or dusted with a suitable surface coating agent.

EXAMPLES

In these examples the following abbreviations have been used: C45AS/AE3S (80:20) ; A mixture of Sodium $C_{14-15}$ Alkyl Sulphate/$C_{13-15}$Alkyl Ethoxy Sulphate in the ratio 80% by weight alkyl sulphate to 20% by weight alkyl ethoxy sulphate.

Example 1

This example describes the process in batch mode in a lab scale high shear mixer (food processor manufactured by Braun [Trade Name]). Three hundred grams of powders are added first to the mixer. In this particular case a 1.2:1.0 ratio of Zeolite A to finely divided light density sodium carbonate is used. The surfactant is an aqueous paste of C45AS/AE3S (80:20) with a detergent activity of 78%, and a water content of 16%. In this example the paste is pre-mixed in a batch mixer with a 40% solution of the co-polymer of maleic and acrylic acid , sodium salt and a 20% solution of the sodium salt of the ethylene diamine-N,N-disuccinic acid. The weight ratio of paste: polymer: chelating agent was 1:0.64:0.09. The mixture is then dried to the original paste moisture of 16%. The paste mixture is placed into an oven at 60° C. until thermal equilibrium is reached. The mixer is then started and paste added at a rate of 500 g/min until the onset of agglomeration and formation of granules. The end point is sharp and easily recognized. It is characterized by an increased power draw by the mixer, and a change in the mixer contents from a mixture of finely divided powders and distributed surfactant paste, to agglomerates containing powders and paste having a mean particle size between 400–600 micrometers. The activity of the agglomerates formed is 51%. The agglomerates were dried in a fluid bed drier and the rate of surfactant release of the resulting agglomerates was tested in a Sotax bath at 20° C. in distilled water (see section B—test method). The time taken for 50% of the surfactant to dissolve is 78 seconds.

Comparative Example 2

This example describes the process in batch mode in a lab scale high shear mixer (food processor) as used in example 1. Three hundred grams of powders are added to the mixer. The powders composition is a 1.2:1.0 ratio of zeolite A to finely divided light density sodium carbonate. The surfactant is an aqueous paste of C45AS/AE3S (80:20) with a detergent activity of 78%, and a water content of 16%. The paste temperature is 60° C. The mixer is started and paste added at a rate of 500 g/min until the onset of agglomeration and the formation of granules. The activity of agglomerates formed is 40%. The agglomerates were dried in a fluid bed drier and the rate of surfactant release of the resulting agglomerates was tested in a Sotax bath at 20° C. in distilled water (see section B—test method). The time taken for 50% of the surfactant to dissolve is 114 seconds.

Comparative Example 3

This example describes the process in batch mode in a lab scale high shear mixer (food processor) as used in example 1. Three hundred grams of powders are added first to the mixer. In this particular case a 1.2:1.0 ratio of Zeolite A to finely divided sodium carbonate is used. The surfactant is an aqueous paste of C45AS/AE3S (80:20) with a detergent activity of 78%, and a water content of 16%. In this example the paste is pre-mixed in a batch mixer with a 40% solution of the co-polymer of maleic and acrylic acid., sodium salt The weight ratio of paste:polymer was 1:0.64. The mixture is then dried to the original paste moisture of 16%. The paste mixture is placed into an oven at 60° C. until thermal equilibrium is reached. The mixer is then started and paste added at a rate of 500 g/min until the onset of agglomeration and formation of granules. The activity of the agglomerates formed is 46%. The agglomerates were dried in a fluid bed drier and the rate of surfactant release of the resulting agglomerates was tested in a Sotax bath at 20° C. in distilled water (see section B—test method). The time taken for 50% of the surfactant to dissolve is 84 seconds.

Comparative Example 4

This example describes the process in batch mode in a lab scale high shear mixer (food processor) as used in example 1. Three hundred grams of powders are added first to the mixer. In this particular case a 1.2:1.0 ratio of Zeolite A to finely divided light density sodium carbonate is used. The surfactant is an aqueous paste of C45AS/AE3S (80:20) with a detergent activity of 78%, and a water content of 16%. In this example the paste is pre-mixed in a batch mixer with a 20% solution of the sodium salt of the ethylene diamime-N,N-disuccinic acid. The weight ratio of paste:chelating agent was 1:0.09. The mixture is then dried to the original paste moisture of 16%. The paste mixture is placed into an oven at 60° C. until thermal equilibrium is reached. The mixer is then started and paste added at a rate of 500 g/min until the onset of agglomeration and formation of granules. The activity of the agglomerates formed is 49%. The agglomerates were dried in a fluid bed drier and the rate of surfactant release of the resulting agglomerates was tested in a Sotax bath at 20° C. in distilled water (see section B—test method). The time taken for 50% of the surfactant to dissolve was 120 seconds.

Example 1 illustrates the product of the present invention.. Example 2 shows a comparison of a product made without chelant or polymer. The surfactant activity is lower and the rate of solubility is poorer. Example 3 shows a comparison of a product made with polymer only (ie without chelant). Good rate of solubility is achieved, but the particulate activity is lower. Example 4 shows a comparison of a product made with chelant only (ie without polymer). Good surfactant activity is obtained but the rate of solubility is poor.

Section B—Test Methods

Rate of Dissolution of Anionic Surfactant Agglomerates under Stressed Conditions (Sotax Method)

Equipment

1) Sotax cup (1L)
2) Distilled water
3) Electrical stirrer motor with variable speed (IKA-Werk RW 20 DZM)
4) Stainless steel propeller stirrer (Sotax no 3990-2)
5) 6 disposable filter type units with pore size 0.22 micron (25 mm diam., Millex No. SLGSO25NB Millipore).
6) Plastic syringes (2 mL) and disposable needles (21× 1½)
7) Sample collectors (15 mL glass tubes)
8) Set of Tyler sieves and sieving equipment (Rotap)
9) Thermostated bath Sample Preparation Take a representative sample of 10 g of the detergent composition.

Experimental Procedure

1) Place the cup containing 1 L of water (or desired solution) in the bath at the desired temperature. Allow the temperature of the water to reach that of the bath.
2) Place the impeller in the cup at 0.33 cm from the bottom.
3) Prepare 5 syringes with a filter unit and a needle. Prepare 1 syringe with needle without the filter.
4) Set the mixer speed to 200 r.p.m.
5) Quickly add 10 g of the product to be tested. Start the stopwatch.
6) Remove, at precise intervals of 10 sec., 30 sec., 1 min., 2.5 min. and 5 min, about 2 mL samples with the syringes. For adequate sampling, the needle has to be ±4 cm below the surface of the liquid.
7) After taking the 5 min. sample, increase the speed of the impeller to 300 r.p.m.
8) After 10 minutes take another sample through the filter.
9) Take a sample of the liquid with the syringe without filter. The difference between the result of this and the previous one is an indication of the solubility that can be expected at this temperature. Care must be taken that during this time, the system does not increase its temperature due to the vigorous stirring action.
10) Carry out the analytical determination of the content of active ingredient (CatSO3 analysis or similar). When using a turbidimetric end point indication for the titration, care must be taken that there is no interference in the unfiltered sample due to the presence of insolubles.
11) Calculate the percent dissolved in each sample by using the unfiltered sample as 100% (by CatSO3 analysis, even the undissolved surfactant will be titrated).
12) Plot the percent dissolved versus time for the first period of time (up to 5 min.). Calculate the percent solubility at the experimental conditions from the filtered sample at 10 min.

What is claimed is:

1. A process for making a high active detergent paste which has a viscosity of at least 10 Pas when measured at 70° C. and a shear rate of 25 $s^{-1}$, comprising:

i) preparing a paste premix which comprises at least 40% by weight of an anionic surfactant; and ii) mixing the paste premix with an aqueous solution comprising a polymer or copolymer which comprises a water soluble salt of a homopolymer or copolymer of an aliphatic carboxylic acid and an aqueous solution comprising a chelating agent selected from the group consisting of succinic acids and salts thereof, phosphonic acids and salts thereof, and mixtures thereof wherein the weight ratio of chelating agent to polymer or copolymer is from about 1:20 to 1:1.

2. A process for making a high active detergent paste according to claim 1 wherein the aqueous solution of the chelating agent comprises from 5% to 60% of said chelating agent.

3. A process for making a high active detergent paste according to claim 1 wherein the aqueous solution of the polymer or co-polymer comprises from 5% to 60% of a copolymer of maleic and acrylic acid having a molecular weight of from 2,000 to 100,000.

4. A free-flowing granular detergent component or composition formed from an aqueous paste made according to the process of claim 1.

5. A process for making a high active free flowing granular detergent composition or component which comprises the steps of:

i) preparing a paste premix which comprises at least 40% by weight of an anionic surfactant;

ii) mixing the paste premix with an aqueous solution comprising a polymer or copolymer which comprises a water soluble salt of a homopolymer or copolymer of an aliphatic carboxylic acid, and an aqueous solution comprising a chelating agent selected from the group consisting of succinic acids and salts thereof, phosphonic acids and salts thereof, and mixtures thereof to give a high active detergent paste which has a viscosity of at least 10 Pas when measured at 70° C. and a shear rate of 25 $s^{-1}$;

iii) mixing the high active detergent paste with an effective amount of powdered materials to agglomerate the high active paste in the high speed mixer, the high active paste having a residence time in the high speed mixer of from 1 second to 30 seconds;

iv) further processing the agglomerate resulting from step iii) by at least one of drying and cooling; and wherein the weight ratio of the chelating agent to the polymer or copolymer is from about 1:20 to 1:1.

6. A process for making a high active granular detergent according to claim 5 wherein a twin-screw extruder is used in step iv) of the process.

7. A process for making a high active granular detergent according to claim 6 wherein a drier is used before the twin-screw extruder.

8. The process according to claim 5, wherein no builder is used to agglomerate the high active paste of step iii).

9. The process according to claim 5, wherein the aqueous solution of polymer or copolymer comprises from 5% to 60% polymer or copolymer.

10. The process according to claim 5, wherein said powdered materials are aluminosilicate ion exchange builder materials.

11. A flee-flowing granular detergent component or composition made according to the process of claim 5, wherein the weight ratio of the chelating agent to the polymer or copolymer is about 7:1.

12. A flee-flowing granular detergent component or composition made according to the process of claim 5, wherein the activity of the detergent component or composition is greater than about 50%.

13. A free-flowing granular detergent component or composition made according to the process of claim 5, wherein the carboxylic acid is selected from the group consisting of maleic acid, itaconic acid, mesaconic acid, fumaric acid, aconitic acid, citraconic acid, methylenemalonic acid and mixtures thereof.

* * * * *